US005605327A

United States Patent [19]

McCutchen

[11] Patent Number: 5,605,327

[45] Date of Patent: Feb. 25, 1997

[54] SHOCK DAMPING RACQUET BUTT CAP

[76] Inventor: Wilmot H. McCutchen, P.O. Box 701129, Houston, Tex. 77270

[21] Appl. No.: 544,832

[22] Filed: Oct. 18, 1995

Related U.S. Application Data

[63] Continuation-in-part of Ser. No. 302,060, Sep. 7, 1994, abandoned.

[51] Int. Cl.[6] ..... A63B 49/08

[52] U.S. Cl. ..... 473/523; 473/549; 473/560

[58] Field of Search ..... 273/72 R, 72 A, 273/67 R, 735, 51, 67 A

[56] References Cited

U.S. PATENT DOCUMENTS

| | | | |
|---|---|---|---|
| 1,026,990 | 5/1912 | Matson | 273/73 J |
| 3,075,768 | 1/1963 | Karns | 273/81 |
| 4,674,746 | 6/1987 | Benoit | 273/81 A |
| 4,811,947 | 3/1989 | Takatsuka et al. | 273/73 J |
| 4,907,810 | 3/1990 | Whiteford | 273/73 J |
| 4,936,586 | 6/1990 | Van Raemdonck | 273/73 J |
| 4,984,793 | 1/1991 | Chen | 273/75 |
| 5,058,902 | 10/1991 | McCutchen | 273/735 |
| 5,069,452 | 12/1991 | Chen | 273/73 J |
| 5,094,453 | 3/1992 | Douglas et al. | 273/72 A |
| 5,180,163 | 1/1993 | Lanctot et al. | 273/72 R |
| 5,454,562 | 10/1995 | Sommer | 273/73 C |

FOREIGN PATENT DOCUMENTS

| | | | |
|---|---|---|---|
| 662110 | 5/1979 | U.S.S.R. . | |
| 11118 | of 1901 | United Kingdom | 273/81 A |
| 13337 | of 1911 | United Kingdom | 273/81 A |

OTHER PUBLICATIONS

Tennis Science for Tennis Players by Howard Brody (University of Pennsylvania Press 1987) pp. 24–59.

"Tennis Elbow Avoided with Fluid Dynamic Racquet", Design News (Jun. 8, 1987) pp. 126–129.

*Primary Examiner*—Mark S. Graham

[57] ABSTRACT

A butt cap for a racquet comprises walls defining a cavity for slidably engaging the handle of the racquet and walls defining a butt ballast cavity for containing a butt ballast. The butt cap is preferably a ellipsoidal, rounded, tapering approximate egg-shape protruding in excess of 1 cm axially beyond the handle end of the racquet so as to add length to a racquet and provide a comfortable surface such that the player may simultaneously grip the handle and the distal extension, particularly on the serve. The advantage of a butt weight for adding power and control to sports striking implements in general is discussed. A racquet having a distal particulate butt ballast not only damps shock but prevents it by adding more mass to the racquet at the distal end thereof. The butt ballast is preferably of loose metal balls approximately 1 mm in diameter. Retrofit of the butt cap in replacement of a conventional butt cap is possible. Means for attachment of the butt cap include axial extensions extending along the handle.

8 Claims, 3 Drawing Sheets

SHOCK DAMPING RACQUET BUTT CAP

This application is a continuation in part of Ser. No. 08/302,060 filed Sep. 07, 1994, now abandoned.

FIELD OF THE INVENTION

The present invention relates to tennis racquets, squash racquets, and racquetball racquets, particularly to the handle thereof. It also relates to means for absorbing shock and increasing the power and control of a sports striking implement, including tennis racquets.

BACKGROUND—PRIOR ART

The butt cap of a tennis racquet is conventionally a flat-ended octahedral cup of black polyethylene secured to the end of the handle of the racquet by staples or by glue. The conventional butt cap comprises only one cavity, for slidably engaging the handle end of the racquet, and functions to prevent the hand of the player from slipping below the handle end and as a platform for the manufacturer's logo and a cover for the part of the handle not wrapped by the grip. Very little of the conventional butt cap extends beyond the hand of a player gripping the racquet. Few improvements have been made to the butt cap, although racquets have undergone a profound transformation in nearly all other features.

Conventionally, a tennis racquet is 68.6 cm in length, although the rules of the International Tennis Federation allow for a maximum length of 81.2 cm. Recently, the advantages of a longer than conventional racquet length have been recognized by tennis professionals. See *Tennis,* Vol. 31, No. 5, September 1995, pp. 32–36. The butt end of such extra-long racquets is flat because they have a conventional butt cap. The extra length of 2.5–5.1 cm is added to the racquet by increasing the length of the racquet head and/or racquet handle, not by increasing any dimension of the butt cap. No means for increasing the length of an existing racquet by means of a butt cap is presently known to the art.

In U.S. Pat. No. 5,058,902 to McCutchen (1991), I disclosed a static distal butt weight for a tennis racquet handle, for the purpose, among others, of extending the center of percussion, absorbing shock, and increasing the momentum of the racquet. In FIG. 6 of that patent, a butt cap for adding the static distal butt weight was described. The means for attachment for the butt cap were stated to be glue or adhesive tape. The structure was that of a conventional butt cap with an octagonal cavity for receiving a handle end of a racquet. There was no cavity in that butt cap, other than the cavity for receiving the handle end. The doorknob-shaped configuration of the butt cap therein described was not such as would permit a comfortable grip below the handle end because of the sharp annular bulge of the butt cap beyond the handle end.

U.S. Pat. No. 5,094,453 to Douglas et al. (1992) shows a tennis racquet with a solid butt weight attached to its handle end by means of an "acorn shaped weighted extension" (4) attachable to the end of the handle by welding or screwing it on (5:8). The extension comprises a "circular disk section" (5) as at the end of a baseball bat, i.e. a sharp radial projection to keep the hand from sliding off the handle end. Such a circular disk section would make impossible any comfortable grip beyond the handle end because the circular disk section, a sharp annular bulge in the structure of the extension, would be in the palm of the player. Indeed, the whole purpose of the circular disk section is that of the annular bulge at the handle end of a conventional baseball batt—to prevent the gripping hand from going below the handle end.

U.S. Pat. No. 5,069,452 to Chen (1991) teaches a conventional butt cap covered by a resilient layer to provide a soft grip.

U.S. Pat. No. 4,984,793 to Chen (1991) teaches an elongated rubber sheath over a conventional butt cap, the sheath extending up the handle with numerous recesses for containing small individual optional weights under the player's hand.

U.S. Pat. No. 4,907,810 to Whiteford (1990) teaches a butt cap configured for the purpose of preventing the racquet slipping from the player's hand and to anchor the grip covering. (6: 64–68). The wails defining the cavity for receiving the racquet handle are slotted.

Prior art of tennis racquets generally considers that low overall racquet weight, distributed mostly in the part of the racquet comprising the string mesh, i.e. the racquet head, is desirable. For example, the Wilson Hammer™ is a light, stiff racquet having a weight distribution similar to that of a hammer: a heavy head and very light handle. But the overall weight, even of the extra-long racquets, is only approximately 311 grams.

Weak players may consider the overall light racquet weight to be an advantage for them, but there is a tradeoff in power and control. Momentum is conserved in any collision, so the lighter racquet must be swung faster to achieve the same ball velocity, and a faster swing means less control. Although the lighter racquet is easier to swing, so that the increased velocity may make up for the reduced racquet mass, when it meets the ball there is a severe deceleration. In the impact with the ball, a light racquet must give up more velocity than a heavy racquet, and this sudden (appproximately 0.004 seconds) braking action, i.e. shock, certainly has no beneficial effect on the muscles and tendons of the player's elbow or on the accuracy of the shot.

Shifting the center of mass further toward the head increases the moment of inertia, making the racquet more difficult to accelerate on the serve and less responsive in volleying. Players generally praise the head-heavy racquet for ground strokes, but condemn it for volleys and serves. The head weight may be small, but it is far from the player's hand and acts on a long lever arm.

It is well known that the velocity of propagation of mechanical waves varies as the square root of the ratio of the elastic modulus of the material to the density of the material. A light, stiff racquet therefore transmits shock very quickly. Vibration sets up in the racquet as the disturbance runs up and down the shaft. Various damping devices, disposed between the hand of the player and the racquet head, have been marketed. No damping means disposed beyond the handle end is known, except for my prior patent, U.S. Pat. No. 5,058,902.

It is also known in physics that a wave rebounding from a heavy medium back into a light medium has a phase shift of $\pi$ radians, i.e. destructive interference, whereas a wave in a heavy medium (such as a racquet shaft) rebounds from a relatively light medium (air) with no phase shift, i.e. constructive interference, so a standing wave sets up. The prior art of tennis racquets focuses on damping vibration once it is created, rather than preventing it.

Tennis elbow, also known as lateral epicondylitis, is a painful condition suffered by many tennis players. There is a great need for a solution to this problem, which appears to have increased during the recent vogue for light, stiff racquets. Vibration damping by means of padded grips, string attachments, asymmetric racquet heads, and assemblies within the racquet handle are the approaches that have been tried.

A stiff, light racquet tends to rotate backward on impact because of the moment contributed by the ball-racquet couple, spoiling the aim of the player, particularly on overheads. Moving the center of mass of the racquet farther from the hand and closer to the center of the strings decreases this moment, but increases the lever arm of the racquet mass center. A head-heavy weight distribution causes a sluggish feel and may, after ball release, contribute to tennis elbow by the following mechanism:

To overcome the moment contributed by the ball-racquet couple during the period of impact (approximately 0.004 seconds), the player must add a counterrotational arresting force by muscle alone, without aid of any ballast in the butt at all (in the conventional racquet). After the ball is released, the equilibrium of moments thus established by muscle force is suddenly disturbed, and the racquet head lurches forward, suddenly pulling on the muscles that attach to the elbow tendons. Then a distant mass center becomes a disadvantage because its longer lever arm gives it a greater pulling force on the elbow muscles and makes the lurch harder to arrest. In addition, the large shock from deceleration of the light racquet on impact causes the racquet to vibrate at the time the player is resisting this lurch.

Solutions of prior art for damping vibration in a racquet, such as padded grips, flexible racquet shafts, and dampers applied to the racquet strings, do not address the fundamental difficulty caused by small overall mass and head-heaviness. A more comprehensive solution is provided by the present invention, a butt cap which not only damps shock but prevents it by adding more mass where it does the most good, at the butt.

OBJECTS AND ADVANTAGES OF THE PRESENT INVENTION

It is an object of the present invention to provide comfortable, graspable means for attaching a significantly large distal butt weight to a tennis racquet so as to increase power and control and damp shock and vibration.

It is also an object of the present invention to provide retrofittable means for adding a comfortable extended surface beyond the handle end of the racquet for the hand of a player to engage, particularly during the serve, so as to extend the length of the racquet.

It is also an object of the present invention to provide means for attaching a dynamic damping butt weight to a tennis racquet. A particulate butt weight, disposed in a butt cap cavity at the end of the racquet, acts as a parasitic mass to damp waves transmitted along the racquet shaft. The disturbance goes from a relatively light to a heavy medium, so there is a phase shift causing destructive interference. The result is that vibration in the racquet is damped. Also, the particles of the butt weight become projectiles, taking energy out of the system. The elastic modulus of the particulate butt weight is low, but its density is high, so the velocity of the pulse in the butt weight is low and the energy dissipates in friction and randomly directed collisions among the particles.

Another object of the present invention is to provide means for increasing the angular acceleration of a sports striking implement generated by a given effort.

Another object of the present invention is to provide means for attaching a butt cap to a tennis racquet or other striking implement without the use of staples or glue. Attachment by means of axial extensions permits retrofitting to existing equipment without machining the handle or using glue or staples.

A racquet having a butt ballast is easier to position for serve returns and volleys because the center of gravity is moved significantly closer to the hand by the butt ballast within the butt cap according to the present invention. Yet the butt ballast does not impede the grip of the player beyond the handle end of the racquet because of the comfortable ellipsoidal configuration of the butt cap.

The increased mass of the racquet due to the butt ballast increases its momentum, therefore in a collision with a ball the racquet will not decelerate as much as a lighter racquet would. Control is therefore improved, and also the final velocity of the ball is greater at a given swing speed according to the principle of conservation of momentum.

Tennis elbow, or lateral epicondylitis, is prevented by the moment of the butt weight, which counteracts the moment of the ball-racquet couple and thus gives a smooth solid feel to the stroke.

Touch, or fine adjustment in racquet positioning, is improved by a distal butt weight. Serve returns, drop shots, volleys, and ground strokes are more accurate because the center of mass is closer to the hand.

Serve returns are more accurate because the racquet is not pushed back and rotated so much by the incoming serve. The mass of the butt weight adds stability to the racquet on impact, as well as quick and fine positioning of the racquet head.

The ellipsoidal, i.e. approximately egg-shaped, butt cap, with a high radius of curvature bulge away from the longitudinal axis beyond the handle end of the racquet, provides a comfortable place for the server's hand to engage on the serve.

SUMMARY OF THE PRESENT INVENTION

A distal extension, protruding axially at least 1 cm beyond the handle end of a racquet, comprises walls defining a cavity for containing a butt ballast. The butt ballast is preferably particulate, of powdered metal, metal pellets, sand, or other solid particles. These particles dissipate disturbances transmitted into them, so that standing waves are not set up by energy rebounding up the racquet handle.

The preferred embodiment of the present invention is a butt cap which may be retrofitted to the handle end of existing octagonal racquets in replacement of the conventional butt cap. The preferred embodiment comprises walls defining a cavity for slidably engaging the racquet handle, as well as walls, continuous with and extending axially beyond the racquet handle walls, defining a cavity for containing a butt ballast.

The shape of the preferred embodiment is ellipsoidal beyond the handle end of the racquet. The high radius of curvature, i.e. slight radial bulge, extension of the butt cap beyond the handle end provides a comfortable surface for the hand of the player to contact such that the player may simultaneously grip the handle and the butt cap, thereby extending the effective length of the racquet when desired, as, for example, on the serve.

A tennis racquet having a particulate butt ballast, either by means of a butt cap or otherwise, protects the player's elbow from stress and has better power and control. The additional weight increases the mass of the racquet so that it decelerates less in collision with the ball, and the distal location of this added mass increases the power. Yet the player holding such a racquet does not perceive it as heavier because the center of gravity is closer to the hand. The particulate butt ballast serves to shunt and dissipate shock.

DETAILED DESCRIPTION OF THE DRAWINGS

Figure 1A:
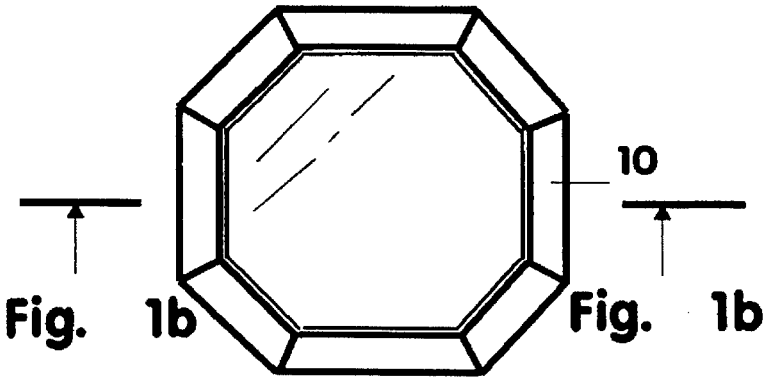
Fig. 1a (Prior Art)
FIG. 1*a* shows a view into the cavity of a conventional butt cap for a tennis racquet.

FIG. 1*a* shows an end view into the cavity of a conventional tennis racquet butt cap (10), showing the octagonal cavity for slidably engaging the handle end of a racquet. The conventional butt cap is a flat cup of polyethylene, extending less than 1 cm along the longitudinal axis of the racquet beyond its handle end, and it serves no functional purpose other than to cover the handle end of the racquet and increase the diameter of the racquet at the handle end so that the hand of the player cannot slip off the handle end.

Figure 1B:
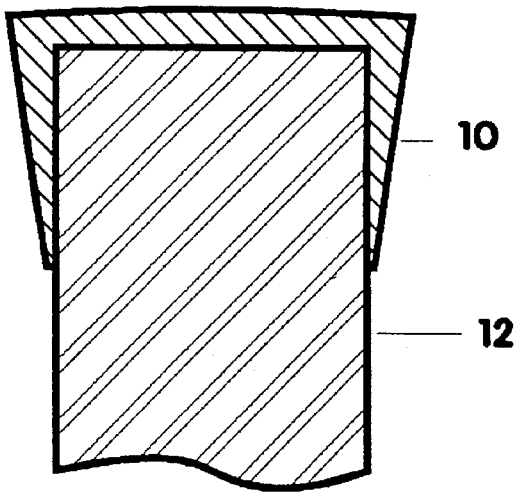
Fig. 1b (Prior Art)
FIG. 1*b* shows a side sectional view of a conventional butt cap for a tennis racquet and the shape of the conventional tennis racquet handle end.

FIG. 1*b* shows a side sectional view of the conventional tennis racquet butt cap shown in FIG. 1*a*. The handle end of the racquet (12) fits into the cavity of the butt cap and is secured thereto by staples or by glue. The top of the butt cap, beyond the handle end, is approximately flat, and is less than 1 cm from the handle end. When the handle end is fully inserted, there is no cavity defined by the conventional butt cap beyond the handle end. The prior art handle end is flat, with its widest point being practially its final point along its longitudinal axis.

Figure 2A:
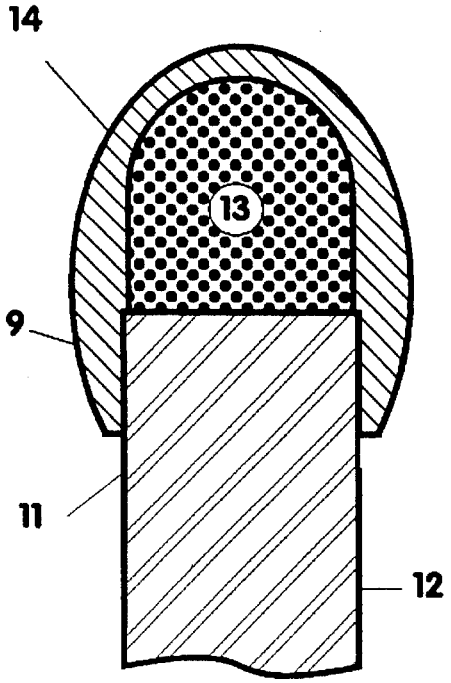
FIG. 2*a* shows a side sectional view of a butt cap for a tennis racquet according to the present invention, comprising a butt ballast of metal particles.

FIG. 2*a* shows a side sectional view of the preferred embodiment of a butt cap for a tennis racquet or squash racquet according to the present invention. The cross-section is taken through the narrowest section of the racquet handle and through the longitudinal axis. A distal extension (14)—preferably an ellipsoidal, rounded tapering approximately egg-shaped dome-like bulge protruding in excess of 1 cm axially beyond the handle end of the racquet (12), and having a greatest outer diameter (measured parallel to the handle end) not less than the diameter of the handle end, nor more than 2 cm greater than the diameter of the handle end—defines a butt ballast cavity for containing a butt ballast (13). Alternatively, the distal extension could be a tapering polygonal shape beyond the handle end. The butt ballast (13), is preferably of copper shot 1 mm in diameter. The butt ballast could also be of other loose particulate material such as sand, lead shot, or powdered metal. The butt ballast could also be solid rather than particulate, or it could be a composite such as powdered bronze in a matrix of low-coefficient-of-restitution elastomer. By the term particulate is meant an aggregate of solid objects of any shape. Of course, a butt ballast of solid metal material may also be used. The butt ballast (13) is disposed within the distal extension (14). The handle (12) slidably engages walls (9) defining a cavity in the butt cap, the walls being continuous around the cavity and connected to the distal extension. Overall, as shown in the drawings, the butt cap has a truncated egg-shape. The profile of the butt cap is shown to be ellipsoidal—i.e. tapering and rounded with a large radial radius of curvature and no sharp annular bulge as in baseball bat handle ends, so that the hand of a player holding the racquet may be supported by a comfortable surface as the hand extends beyond the handle end. Tennis players of the top rank frequently grip the racquet slightly beyond the handle end on the serve.

The material of the butt cap is preferably polyurethane having a hardness of at least 80 Shore A because a softer material allows particles to slip out along the racquet handle. A rigid dome-shaped cup of aluminum (not shown), inserted into the butt ballast cavity, would maintain the shape of the butt cap where soft material is used. Preferably, the material of the butt cap has damping characteristics, i.e., a low coefficient of restitution. Other materials could also be used to manufacture the butt cap, such as ABS plastic, polyethylene, wood, laminated leather, or metal.

Figure 3:
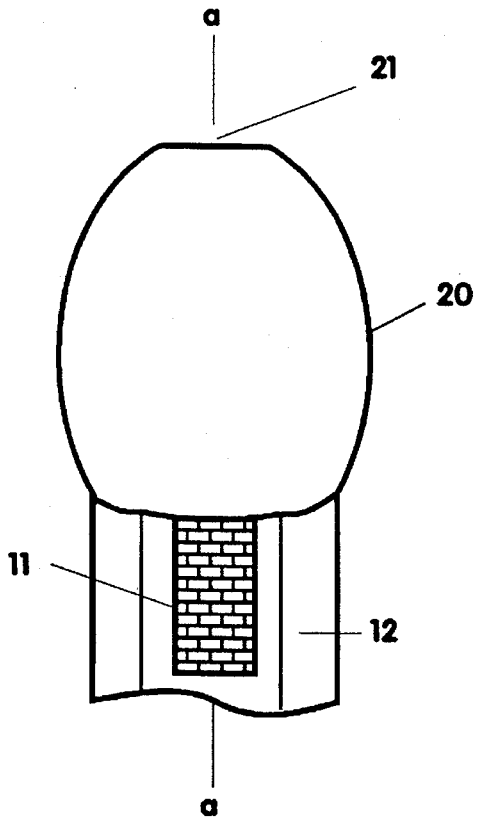
FIG. 3 shows a side elevational view of the preferred embodiment of the butt cap for a tennis racquet, with axial extensions for attachment of the butt cap.

Means for attachment of the butt cap to the handle are either the conventional means of staples or glue or axial extensions as shown in FIG. 3. The butt cap is retrofittable to an existing racquet in replacement of the old butt cap.

Figure 2B:
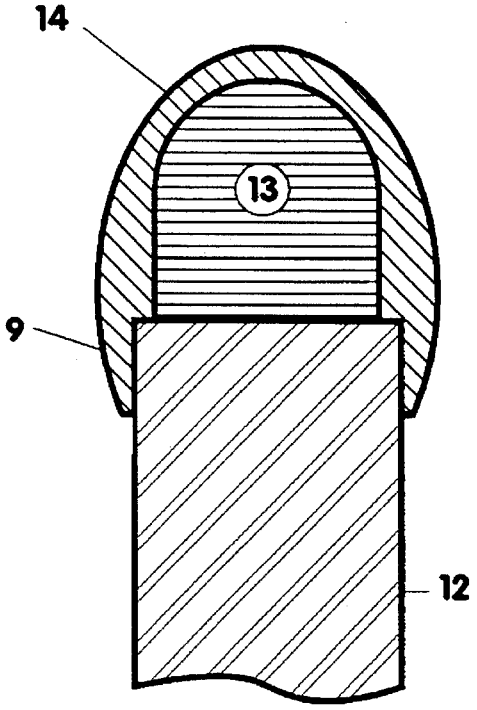
FIG. 2*b* shows another side sectional view of the butt cap for a racquet according to the present invention, comprising a butt ballast of stacked disks.

FIG. 2*b* shows another side sectional view of the preferred embodiment, this time through the widest section of the racquet, and with a butt ballast (13) of metal disks. Note that in this section, the racquet handle end abuts a shelf formed by the butt cap interior. To lessen the weight of the ballast, disks of lighter material are substituted for some of the metal disks. The butt weight is adjustable to suit the player.

FIG. 3 shows a side elevational view of the preferred embodiment of a butt cap for a tennis racquet or squash racquet, showing the ellipsoidal, round, tapering approximate egg-shape of the butt cap, the dome-like distal extension, and at least one pair of axial extensions (11) along the racquet handle (12), the axial extensions providing means for attaching the butt cap to the handle. The axial extensions are preferably fiber reinforced tape having adhesive on opposite halves of each side thereof. The butt cap is attached to the handle by first sticking the axial extensions to the butt cap, then sliding the handle into the butt cap over the adhesive-less half side of the axial extension, then connecting the axial extension to the handle. The means for connecting the axial extensions to the handle could be staples or tape wrapped around the handle and over the axial extensions, but preferably the axial extensions are adhered by adhesive substance between the axial extensions and the handle. The longitudinal axis of the racquet is shown by (a—a). The longitudinal axis extends approximately along the centerline of the handle. The butt cap swells to a first point (20) where it is greater in all its diameters than the handle (12), then decreases to a final point (21), the final point being less in all its diameters than the handle (12). These diameters, of course, are all normal to the longitudinal axis (a—a). Between the first and final points (20, 21) the butt cap is rounded, tapering, and resembles approximately an egg-shape. As shown in the drawings, there is no low radius of curvature radial projection as in a baseball bat handle end, which would make it impossible for a hand to grasp comfortably around it. A grip covering as is known to the art extends along the distal extension to prevent slipping of a player's hand when grasping the butt cap. The distance axially from the first point to the final point, along the longitudinal axis of the racquet, said longitudinal axis extending through the handle to the racquet head, is greater than 1 cm.

The butt cap (32) comprises walls defining a cavity for slidably engaging the handle end (33) of the hockey stick. Shims (31) provide a tight fit between the handle end and the butt cap. The butt cap also comprises walls (35) defining a cavity for containing a butt ballast (34), the butt ballast being disposed beyond the hands of the player. The butt ballast assembly is attached to the stick by adhesive tape, mechanical means, or glue. The magnitude of the butt weight may be chosen to suit the capabilities of the player. Preferably the butt ballast weighs at least 100 grams. The butt ballast is disposed beyond the hands of the player using the stick. The mass of the butt ballast brings the center of mass closer to the player's hands, for better control, and also increases the mass of the stick in the collision with the puck. By the principle of conservation of momentum, the increased mass makes the puck go faster at a given stick speed and increases accuracy by reducing the rebound of the stick in the collision. The shape of the butt cap (32) is preferably egg-shaped, but of course other configurations are possible without departing from the teachings of the present invention. The advantages of adding a significant butt weight to a hockey stick are increased power and better control.

Figure 4:
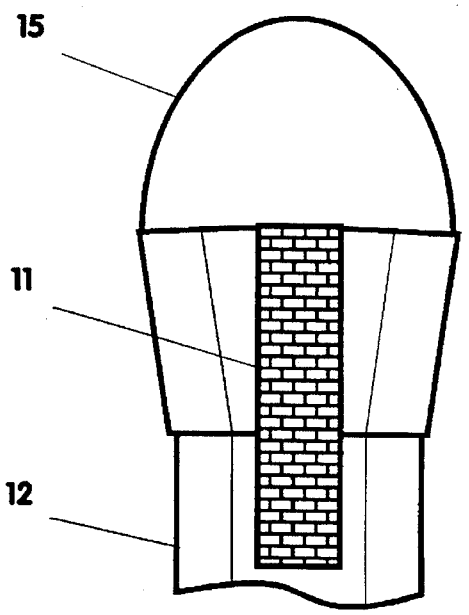
FIG. 4 shows a side elevational view of an alternative embodiment of a butt ballast assembly attached over a coventional tennis racquet butt cap to the handle end of a racquet by means of axial extensions.

FIG. 4 shows a butt ballast assembly (15) attached to a racquet handle (12) by means of a pair of long axial extensions (11) over the existing butt cap of the racquet. The axial extensions are fiber reinforced tape molded into the material of the walls of the butt ballast assembly. The means for attaching the axial extensions to the racquet handle is preferably adhesive as discussed under FIG. 3. Alternatively, tape wrapped around the axial extensions and the racquet handle might be used. Because the fit between the butt ballast assembly and the handle end is only rough, rough edges are smoothed out by dipping the handle end and the butt ballast assembly into a liquid rubber compound such as Plasti-Dip®. The shape of the butt ballast assembly is rounded and tapering so as to present a comfortable surface for the hand of the player to engage beyond the handle end of the racquet.

OPERATION, RAMIFICATIONS, AND SCOPE

Advantages of a butt weighted racquet were discussed in my prior patent, U.S. Pat. No. 5,058,902 (1991). The present invention provides means for secure and easy attachment of a distal butt weight while also providing a comfortable surface for the player's hand to engage beyond the racquet handle end. It also provides means for improving the damping provided by the butt weight.

The butt cap and the butt ballast therein provide means for shunting and dissipating resultant forces from impacts on the racquet head. The butt ballast may be compared to the heat sink known to the art of soldering electronic components. A particulate butt ballast has the advantage of being adjustable in weight as well as more dissipative. The particles turn into projectiles when a force is transmitted into them, so even though they are part of the racquet system for purposes of computing momentum and moment of inertia, they serve to dissipate kinetic energy coming from the racquet head by friction and randomly directed collisions confined within the butt ballast cavity.

When the index finger point of the hand of the player pushes the racquet handle in rotation about the axis of rotation, the middle finger point, the butt ballast also swings around this middle finger axis, resulting in what may be called a butt force. The couple of the butt force and the index finger point pressure contributes a moment, or rotational force in the racquet. This moment due to the butt weight is opposite to the moment contributed by the couple of the ball force and the mass center force of the racquet. About the axis of rotation at the middle finger, the sum of moments will be the ball-racquet moment minus this countervailing rotational force. The reduced total moment in the racquet serves to keep the racquet from rotating backward after the ball is struck, thereby reducing sailing on overheads and the other troubles caused by rotational forces in the racquet.

The means for adding a butt weight are the butt ballast cavity defined by the walls of the butt cap beyond the walls defining a cavity for receiving the handle end of a racquet. This cavity may be filled with a butt ballast of a weight to suit the preference of the player.

The additional mass of the butt weight also adds to the momentum of the racquet, which has the advantage of improving accuracy because the racquet is not decelerated so much by the collision with the ball. The sudden (typically 0.004 second) loss in racquet velocity is shock, which is to be avoided.

Assume it is desired to return a serve received at 100 mph, i.e. 161 km/h or 44.7 m/s, The 57 g tennis ball has an initial momentum of −2.55 kg-m/s. The receiver desires the speed of the return to be 97 km/h, or 27 m/s, for a ball final momentum of 1.54 kg-m/s.

The conventional head-heavy light (0.314 kg) racquet will have some initial velocity ($V_i$) and some final velocity ($V_f$) after impact, both velocities being in the same direction. By the principle of conservation of momentum (approximately linear):

$$0.314V_i - 2.55 = 0.314V_f + 1.54$$

$$V_f - V_i = \frac{-4.09 \text{ kg-m/s}}{0.314 \text{ kg}} = -13.03 \text{ m/s}$$

A butt-weighted racquet (0.485 kg) will have some initial velocity ($V_I$) and some final velocity ($V_F$) with the same initial and final conditions of the tennis ball:

$$0.485V_i - 2.55 = 0.485V_f + 1.54$$

$$V_F - V_I = \frac{-4.09 \text{ kg-m/s}}{0.485 \text{ kg}} = -8.43 \text{ m/s}$$

By the foregoing calculations, the light racquet loses 35% more velocity on impact than the butt weighted racquet. This is the case on any shot, including the serve. The loss of velocity occurs in only 0.004 seconds. In the above case, the deceleration of the light racquet was 3257 m/s$^2$ as opposed to 2108 m/s$^2$ for the heavy racquet.

The deceleration of the racquet mass center is a force applied on a lever arm, the lever arm being the distance of the mass center from the axis of rotation, the elbow. Head-weighting puts this mass center far away, increasing the lever arm and therefore aggravating the torque on the elbow, while butt-weighting reduces the lever arm.

In the above example, with the conventional light and head-heavy (0.314 kg) racquet having a center of mass 0.58 m from the elbow, and the heavy, butt weighted (0.485 kg) racquet having a mass center 0.43 m from the elbow, the torque on the elbow from the impact using the light, head-heavy racquet is 35% greater.

The player's arm muscles compensate for this impact torque, but after the impact is over the compensating muscle pull continues, and the distant mass center, pulled by these muscles, tears other muscles that may try to restrain it. The ballasted butt cap of the present invention reduces the whipsawing of the player's arm by the racquet because it provides means for bringing the mass center closer to the player's hand. The more distal the disposition of the butt weight, the less weight is needed to effect a significant mass center shift.

A butt weight comprising a particulate butt ballast would not only reduce the deceleration according to the calculations above simply by the increased mass of the racquet, and reduce the lever arm on which the deceleration operates, but it would also damp any disturbances transmitted through the racquet shaft, such as resultant forces from off-center-of-percussion impacts on the frame or the strings of the racquet. These forces are transmitted down the stiff racquet frame and into the butt cap, whereupon the particles become confined projectiles, temporarily removing the force from the system and then dissipating it by friction in a multitude of collisions over time.

The butt ballast according to the preferred embodiment can be customized in weight to suit the strength and other requirements of different players, in consultation with their pro or stringer. It is the player's responsibility to choose the proper amount of weight to suit the condition of the arm and the player. Weak players, intending to serve American Twist services, should not attempt to swing a 300 gram butt weight. No warranties of any kind are made in the present specification or in the claims. The present invention provides a container for the weight chosen by the player.

Of course, the cavity could be filled in with the same material as the butt cap itself, so that a solid knob of butt cap material projects beyond the handle end of the racquet. For power, however, a heavy butt cap is advantageous, and a cavity allows for the attachment of an adjustable metal weight, such as shot or metal disks.

A composite of low-coefficient-of-restitution urethane and powdered metal would provide weight and shock absorbing capacity. The improved butt cap according to the present invention could made of such a composite as a solid molded piece.

The preferred embodiment provides a comfortable extension to the butt cap without the edges and voids that would result from the alternative embodiment, the stick-on butt ballast assembly, and without the additional step of dipping the butt ballast assembly and the racquet handle.

It is obvious that configurations other than the rounded, tapering approximate egg-shape shown in the drawings are possible for the butt cap, such as a tapering octahedral structure. Such other shapes are intended to be covered by the claims herein, and are merely trival and obvious variations. The advantages gained by extending and tapering the handle end of a racquet by means of a butt cap according to the present invention are: (1) an extension provides means for attaching a distal butt weight, (2) even if no butt weight is desired, the tapering extension, in excess of 1 cm along the longitudinal axis of the racquet, provides a surface for the player's hand to engage with an improved grip, especially on the serve, and (3) increased power and accuracy are provided by the increased length, as recognized by prior art, and these advantages may be realized by retrofitting an existing racquet with the butt cap of the present invention.

Add the butt ballast to the butt ballast cavity of the butt cap, apply axial extension tapes to the inside of the walls defining the cavity for slidably engaging the racquet handle end, slide the handle end into the cavity, secure the axial extensions to the handle, then reapply the grip covering. A sleeve of foam urethane is a preferable grip covering because it can be extended up the butt cap.

See the discussion above on moment of inertia and conservation of momentum. Obviously, adding a butt weight by means other than the butt cap described herein is included in the present invention. For example, a screw-on or glue-on butt weight for a hockey stick would not be novel in light of the teachings of the present invention. Adding the butt weight by means of a butt cap is advantageous because the handle end shape is neater and the butt weight is more securely fastenend to the handle end.

Those skilled in the art upon reading of the above detailed description of the present invention will appreciate that many modifications of the apparatus described above can be made without departing from the spirit of this invention. All such modifications which fall within the scope of the appended claims are intended to be covered thereby.

I claim:

1. A butt cap for a racquet, the racquet having a polygonal handle terminating in a handle end and having a longitudinal axis extending along a centerline of the handle, the butt cap comprising:

walls defining a polygonal cavity for slidably engaging the handle, and a distal extension continuous with said cavity defining walls and protruding at least 1 cm along the longitudinal axis beyond the handle end;

the butt cap having a truncated egg-shape with smoothly tapering longitudual sections through said cavity defining walls and said distal extension such that a hand might comfortably grasp around said cavity defining walls and said distal extension simultaneously without encountering any low radius of curvature radial projection.

2. The butt cap of claim 1, wherein the butt cap is made of polyurethane having a hardness of at least 80 Shore A.

3. The butt cap of claim 1, wherein a particulate butt ballast is disposed within the butt ballast cavity.

4. The butt cap of claim 1, wherein said truncated egg-shape comprises tapering longitudinal facets.

5. The butt cap of claim 1, further comprising striations on the distal extension.

6. The butt cap of claim 1, further comprising means for attaching a thong.

7. The butt cap of claim 1, further comprising at least one pair of axial extensions for extending along a racquet handle.

8. The butt cap of claim 7, wherein the axial extensions comprise tape.

* * * * *